US011687043B2

(12) United States Patent
Rochat

(10) Patent No.: US 11,687,043 B2
(45) Date of Patent: Jun. 27, 2023

(54) CHRONOGRAPH RESET SYSTEM

(71) Applicant: Montres Breguet S.A., L'Abbaye (CH)

(72) Inventor: Jean-Philippe Rochat, Les Bioux (CH)

(73) Assignee: Montres Breguet S.A., L'Abbaye (CH)

( * ) Notice: Subject to any disclaimer, the term of this patent is extended or adjusted under 35 U.S.C. 154(b) by 321 days.

(21) Appl. No.: 17/164,170

(22) Filed: Feb. 1, 2021

(65) Prior Publication Data

US 2021/0278808 A1 Sep. 9, 2021

(30) Foreign Application Priority Data

Mar. 5, 2020 (EP) ..... 20161120

(51) Int. Cl.
*G04F 7/08* (2006.01)

(52) U.S. Cl.
CPC ..... *G04F 7/0819* (2013.01); *G04F 7/0814* (2013.01)

(58) Field of Classification Search
CPC ..... G04F 7/0819; G04F 7/0814
See application file for complete search history.

(56) References Cited

U.S. PATENT DOCUMENTS 7,422,364 B2 * 9/2008 Scheufele ..... G04F 7/0809 368/106
9,164,492 B2 * 10/2015 Philippine ..... G04F 7/0819

FOREIGN PATENT DOCUMENTS

| | | | |
|---|---|---|---|
| CH | 704 752 | B1 | 10/2012 |
| EP | 1 746 471 | A1 | 1/2007 |
| EP | 1 890 205 | A1 | 2/2008 |
| EP | 2 073 078 | A1 | 6/2009 |
| EP | 2 884 350 | A2 | 6/2015 |

OTHER PUBLICATIONS

European Search Report of EP 20 16 1120 dated Aug. 27, 2020.

* cited by examiner

*Primary Examiner* — Sean Kayes
*Assistant Examiner* — Sean R Brannon
(74) *Attorney, Agent, or Firm* — Sughrue Mion, PLLC

(57) ABSTRACT

A system (1) for resetting a chronograph is provided with a chronograph counting geartrain (2), which includes a minute counter having a minute wheel set (4), and a seconds counter, which includes a chronograph wheel set (3). The system includes a hammer held blocked by blocking device (11) and displaceable from an inactive position, where the hammer is blocked by the blocking device, and an active position, when the hammer is unblocked, for resetting the chronograph in contact with the various wheel sets (3, 4); a flexible element (10) connected between a reset controller (12) and the hammer for resetting the chronograph, and configured to store energy during a displacement of the controller and before unblocking the hammer blocked by the blocking device to be able, when the hammer is unblocked, to restore this stored energy and drive the hammer to reset the chronograph.

15 Claims, 5 Drawing Sheets

CHRONOGRAPH RESET SYSTEM

CROSS-REFERENCE TO RELATED APPLICATIONS

This application claims priority to European Patent Application No. 20161120.9 filed Mar. 5, 2020, the entire contents of which are incorporated herein by reference.

FIELD OF THE INVENTION

The invention relates to a chronograph reset system. The system is provided with a chronograph counting geartrain, which comprises at least a minute counter having a minute wheel set, and a seconds counter, which comprises a chronograph wheel set. The system comprises a hammer held blocked by a blocking means and able to be displaced from an inactive position, where the hammer is blocked by the blocking means, and an active position, when the hammer is unblocked, for resetting the chronograph in contact with the various wheel sets.

BACKGROUND OF THE INVENTION

Generally, a chronograph mechanism comprises a chronograph counting geartrain, which allows time to be counted from the second by means of a chronograph wheel set or seconds counter, to the minute by means of a minute counter, and optionally to the hour by means of an hour counter. Each counter comprises an indicator organ displacing on a corresponding graduated scale. When the chronograph is reset, the indicator organs are conventionally indexed to an angular position corresponding to the zero of each graduated scale. For this purpose, each indicator organ is generally carried by the axis of a corresponding element of the geartrain. The connection between the geartrain element and its axis is frictional, so as to allow for these two organs an independent angular displacement, beyond a certain torque. The indicating organs are indexed by means of heart-piece mechanisms and corresponding hammers. The use of frictional connections and heart-piece and hammer mechanisms means that the torque to be supplied when resetting the various counters can be large, and a lot of energy is consumed.

By way of comparison, in a conventional chronograph timepiece, a device called "buckling" device is often used. Such a device creates a hard point when pressing a push-button and once the hard point has passed, by an inertia effect the resetting function is performed. It should be noted that the spring pressed and which has passed the hard point has a negative friction effect throughout its resetting function, and a large amount of energy is consumed.

Under these conditions, a means must be found allowing this energy consumed only for resetting the various counters to be compensated for. An additional barrel can be used to provide the necessary energy, but problems of congestion are observed compared to the other basic elements of the timepiece. It is therefore important to have other mechanisms available for resetting the chronograph.

Patent application EP 2 884 350 A2 describes a device for resetting a chronograph watch. The device comprises in particular hammers and hammer blocking means. Springs are disposed between control means and each hammer. The reset hammers can pivot independently of each other and cooperate with a corresponding reset cam, to reset the chronograph.

SUMMARY OF THE INVENTION

The purpose of the invention is therefore to overcome the disadvantages of the prior art by providing a chronograph reset system, in particular a timepiece. An objective of the invention is specifically to benefit from an accumulation of energy of a flexible element, such as an embedded spring, linked to a hammer to restore this energy when the hammer is unblocked for the resetting of the chronograph.

To this end, the invention relates to a chronograph reset system, which comprises the features defined in the independent claim 1.

Particular embodiments of the reset system are defined in the dependent claims 2 to 15.

An advantage of the chronograph reset system according to the invention lies in the fact that it comprises a flexible element fastened by a first end to an upper end of a hammer, and by a second end to a first portion of a control lever rotatably mounted on a base or a frame or a plate of the timepiece. During a chronograph reset operation, an external activation organ, such as a push-button, is pressed on a second portion of the control lever causing the lever to rotate around its axis of rotation, and thus to drive the second end of the flexible element, such as an embedded spring, with a certain force so that it stores energy during this operation.

Another advantage of the chronograph reset system according to the invention lies in the fact that it comprises a means for blocking the hammer, which is preferably a hook organ rotatably mounted on a base or a frame or a plate of the timepiece and blocking the hammer by a fixed pin mounted on the hammer when the hook at a first end hooks onto the pin. Before pushing the second end of the hook organ by one end of the second portion of the control lever, this end of the second portion of the control lever is initially remote from and facing the second end of the hook organ. Thus, during the action of the push-button pushing the second portion of the control lever, the flexible element is stressed and stores energy even before the second end of the hook organ is pushed. This flexible element still stores energy until the hook of the first end of the hook organ is no longer in contact with the blocking pin. After that, the hammer is driven by the first end of the flexible element having stored enough energy which it restores to operate a reset of the chronograph.

Thus, the system allows energy to be stored by means of the flexible element to perform a function of resetting the chronograph, and also allows clear triggering without friction by means of the hook organ when unblocking the hammer to reset the chronograph.

BRIEF DESCRIPTION OF THE DRAWINGS

The purposes, advantages and features of the chronograph reset system will appear better in the following description, in particular with regard to the drawings wherein.

DETAILED DESCRIPTION OF THE INVENTION

In the following description, elements of a chronograph reset system, which are well known in this technical field, will be described only briefly.

Figure 1A:
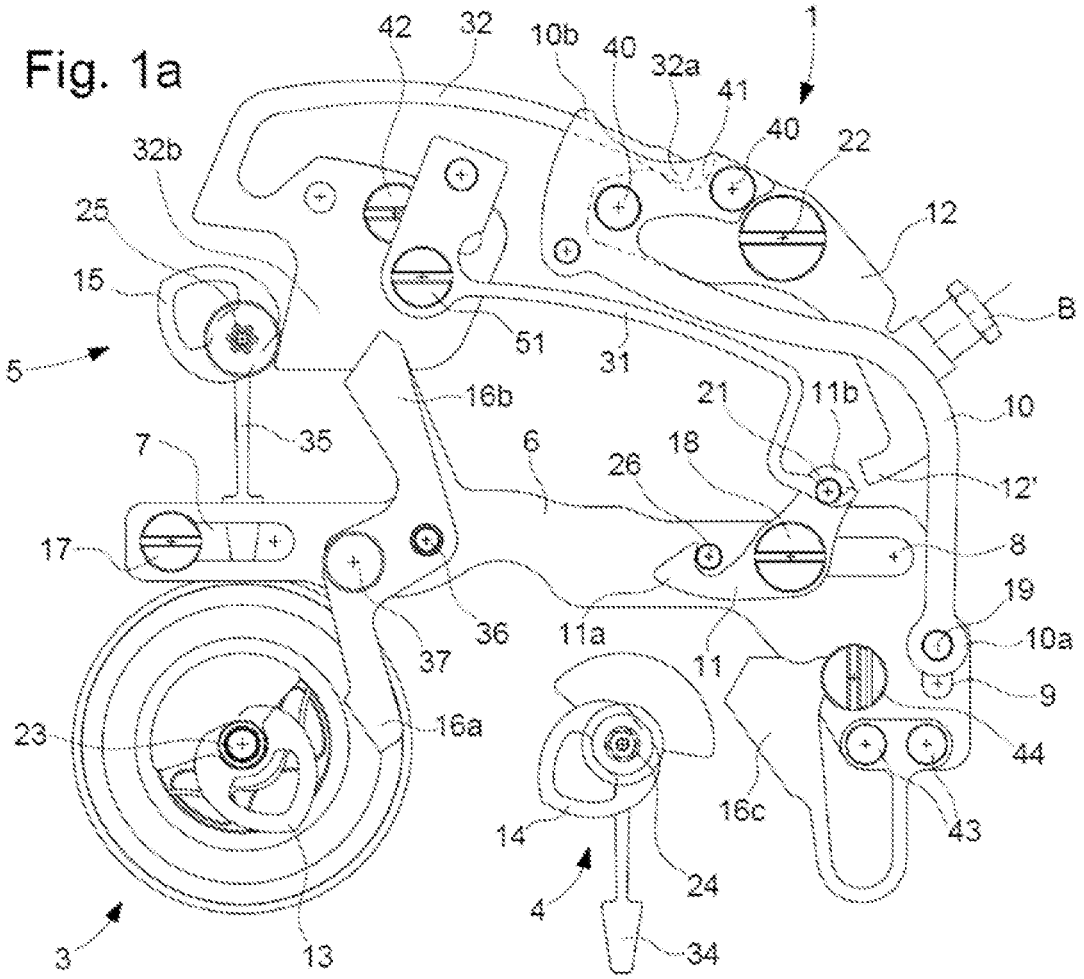
FIGS. 1*a* and 1*b* show a bottom view and a three-dimensional bottom view of the chronograph reset system before the resetting operation of the chronograph according to the invention.
Figure 1B:
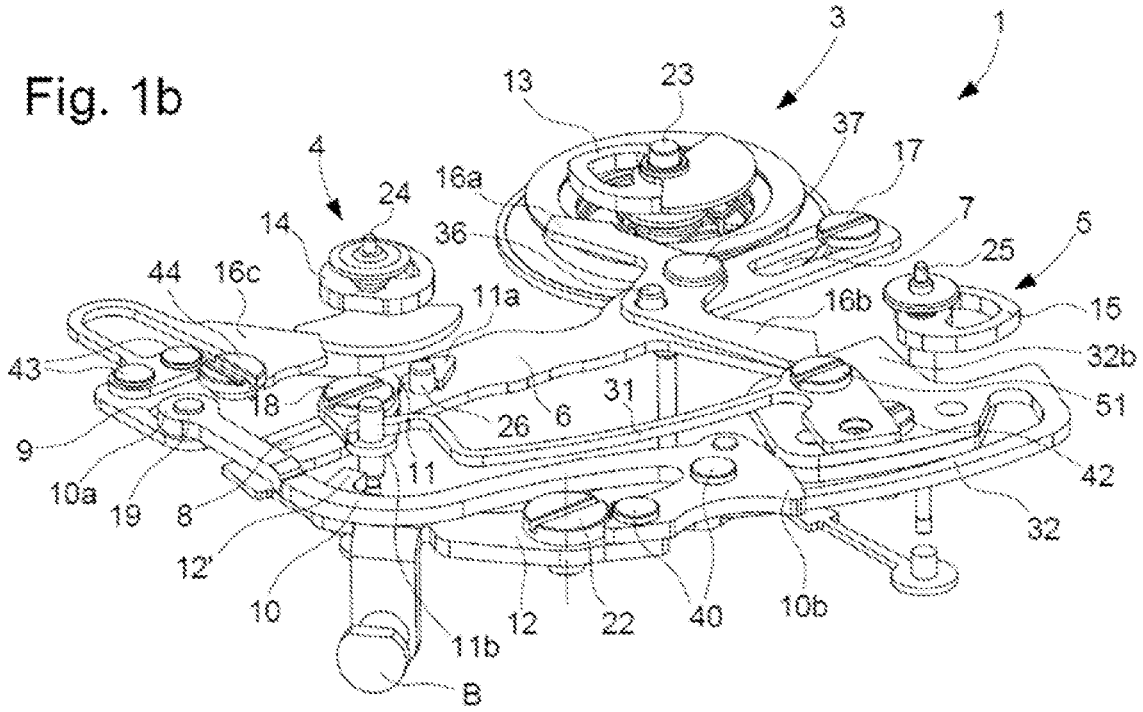

FIGS. 1*a* and 1*b* show a bottom view of the main elements of a system 1 for resetting a chronograph in a position before the resetting operation. It is normally also composed of a chronograph counting geartrain 2 shown in more detail in FIGS. 4 and 5 described below. It can be considered to mount the reset system 1 in a timepiece comprising a basic time movement and a chronograph movement, which can be autonomous with its own movement, and therefore its own barrel. However, it can also be provided to use the basic movement of the timepiece with the chronograph.

Figure 4:
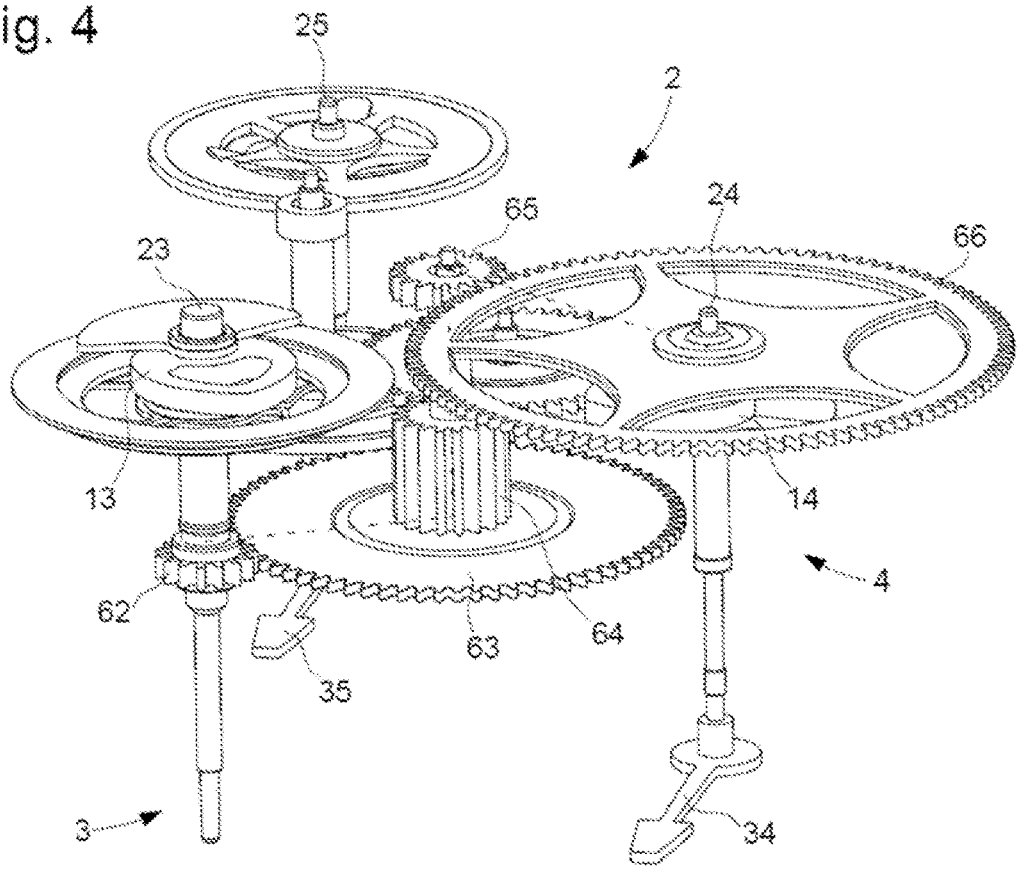
FIG. 4 shows a three-dimensional view of a chronograph counting geartrain, mainly showing a minute counter geartrain of the reset system according to the invention.
Figure 5:
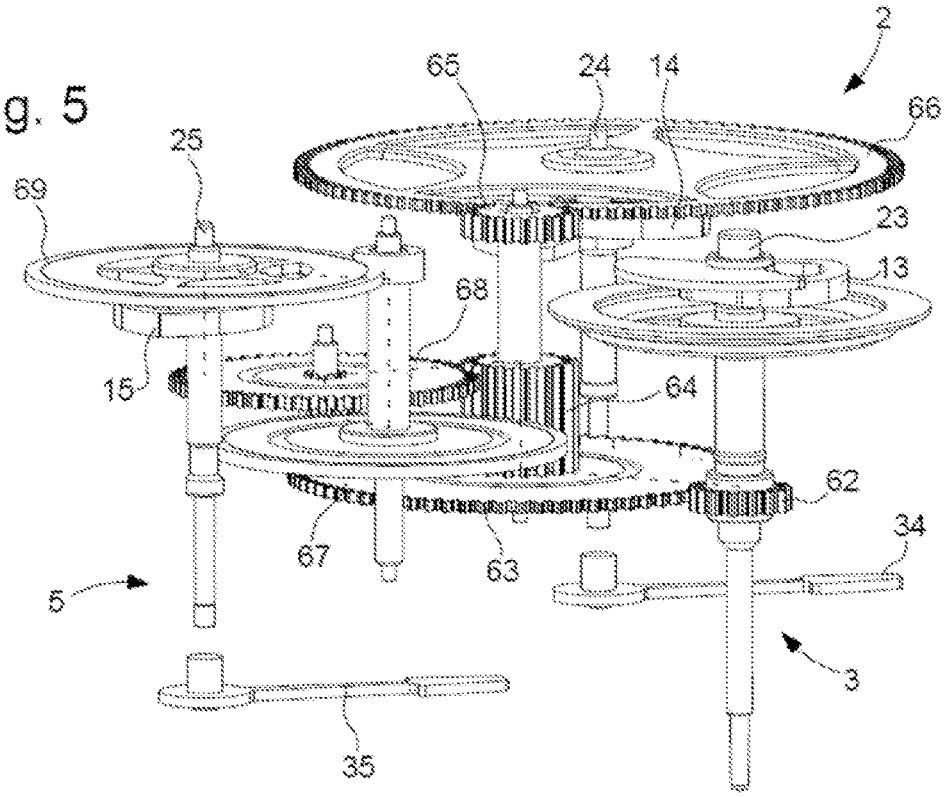
FIG. 5 shows a three-dimensional view of a chronograph counting geartrain, mainly showing a minute-hour counter geartrain of the reset system according to the invention.

The reset system 1 comprises a chronograph wheel set 3, which is normally the seconds wheel set, which is part of the chronograph counting geartrain 2 of FIGS. 4 and 5. This chronograph counting geartrain comprises in particular a minute counter, which comprises a minute wheel set 4, and a seconds counter, which comprises a chronograph wheel set 3. The chronograph counting geartrain may also comprise an hour counter, which comprises an hour wheel set 5. The chronograph or seconds wheel set 3 includes a heart-piece 13 mounted on the central axis 23 of the chronograph wheel set, this heart-piece 13 constitutes a cam shape. The minute wheel set 4 includes a heart-piece 14 mounted on the central axis 24. Finally, the hour module 5 includes a heart-piece 15 mounted on the central axis 25.

It should be noted that a timepiece equipped with a chronograph usually comprises chronograph wheel sets, which are mounted to pivot in friction on a frame or a plate of the timepiece. This means that when resetting the chronograph, it is possible to rotate, with sufficient torque, the wheel sets held only by friction by their axis in an opening provided for this purpose, until the chronograph reset indication.

The reset system 1 mainly comprises a flexible element 10, which may be an embedded spring, which is connected between a reset control means 12 and an end part of the hammer 6, which is used for resetting the chronograph. The flexible element 10 is configured so as to store energy during a displacement of the control means 12 and before unblocking the hammer 6 blocked by a blocking means 11 to be able, when the hammer 6 is unblocked, to restore this stored energy and drive the hammer 6 to reset the chronograph.

Primarily, the flexible element 10 is linked by a first end 10*a* to the hammer 6, for example to an end portion of the hammer 6 used for resetting the chronograph. A pin 19 is inserted at the first end 10*a* of the flexible element 10 and is housed in an elongated opening 9 formed at a flat upper end of the hammer 6. The second end 10*b* of the flexible element 10 is fastened to the control means 12, which is mounted on the base or the frame or the plate of the timepiece, and is used during the resetting operation of the chronograph. The flexible element 10, such as the embedded spring, is arcuate in shape between its first end 10*a* and its second end 10*b*. This shape which is arcuate in the direction of an external activation organ B, such as a push-button, which can act on the control means 12, can be adapted to improve the energy stored before resetting the chronograph.

The control means 12 is preferably a control lever, for example a flat control lever, which is rotatably mounted preferably by a fastening element 22, which is rather a screw 22 passing through a central opening of the control lever and which is fixedly screwed into a corresponding thread in the base or the frame or the plate of the timepiece. This control lever 12, which is rotatably mounted about the axis defined by the screw 22, comprises a first portion on a first side of the axis, on which the second end 10*b* of the flexible element 10 is fastened by stud-bolts 40 or other fastening means. The control lever 12 further comprises a second portion on a second side of the axis of rotation opposite to the first side, and at one end of which can act a push-button B in order to reset the chronograph. As explained below according to the invention, in a blocked position, the hammer 6 is held blocked by a blocking means 11. Just before resetting the chronograph, the push-button B presses the second rotating portion of the control lever 12 and therefore acts first of all on the flexible element from its second end 10*b* to perform an accumulation of energy before the effective unblocking of the hammer 6, which occurs by pressing the push-button B even further.

The hammer 6 is preferably a metal plate, and is mounted in translation with a first longitudinal opening 7 and a second longitudinal opening 8 wherein are placed fixed rods 17, 18, which are for example a first screw 17 and a second screw 18. These two screws 17, 18 can be screwed into threads provided for this purpose on a base or a frame or a plate of the timepiece not shown, but leaving the hammer free to move between an inactive blocking position and an active reset position. The two longitudinal openings 7, 8 are preferably of the same length and on the same line over the length of the hammer 6. The length of the longitudinal openings is adapted such that the hammer 6 can occupy an inactive blocking position and an active reset position of the chronograph in contact with the various heart-pieces 13, 14 of the wheel sets 3, 4 or also of the heart-piece 15 of the wheel set 5 explained below.

The blocking means 11 of the hammer 6 is preferably a hook organ 11 rotatably mounted on the hammer 6. The flat-shaped hook organ 11 comprises a central opening through which passes the second screw 18, the thread of which is in the second longitudinal opening 8 of the hammer 6 defined as the upper side of the hammer 6, where the push-button B acts. The hook organ 11 comprises at a first end 11*a*, a hook for hooking onto a pin 26 fastened vertically on the hammer 6 near the second longitudinal opening 8 and between the two longitudinal openings 7, 8 of the hammer 6. The second end 11*b* of the hook organ 11, which is located on an opposite side relative to the axis of rotation of the second screw 18, comprises a rod 21 by which a first free end of a return spring 31 of the hook organ 11 can act to return the hook organ 11 to a blocked position of the hammer 6. A second end of the return spring 31 can be fastened by a screw 51 screwed into a corresponding thread made in the base or the frame or the plate of the timepiece.

For a chronograph reset operation, an inner end 12' of the second portion of the rotary control lever 12 is disposed facing and remote from the second end 11*b* of the hook organ 11. When the push-button B is pressed for a reset operation of the chronograph, the flexible element 10 first of all stores energy by the rotation of the control lever 12 after the pressure on the push-button B. The flexible element 10 already stores energy before the inner end 12' of the second portion of the control lever 12 pushes the second end 11*b* of the hook organ 11, until the hook of the first end 11*a* of the hook organ 11 no longer hooks the pin 26 of the hammer 6, which allows a clear triggering without additional friction. In this state, the hammer 6 is no longer in a blocked position and can act more easily to reset the chronograph thanks firstly to restoring the energy stored by the flexible element 10 and subsequently by the pressure of a user on the push-button B.

Thanks to this energy stored by the flexible element 10 just before the unblocking of the hammer 6, the resetting operation of the chronograph is facilitated. The hammer 6 is pushed by the flexible element 10 from its first end 10*a* and in the direction of the various wheel sets 3, 4, 5, in particular the heart-pieces 13, 14, 15 of the wheel sets. For this purpose and in the case of the three wheel sets available, the hammer 6 comprises three contact portions 16*a*, 16*b*, 16*c*. A first contact portion 16*a* disposed on the hammer 6 contacts the heart-piece 13 of the chronograph wheel set 3. A second contact portion 16*b* disposed on the hammer 6 contacts the heart-piece 15 of the hour wheel set 5. The first contact portion 16*a* and the second contact portion 16*b* form an assembly rotatably mounted about an axis 37 on the hammer 6 near the first longitudinal opening 17. An angular stop 36 is provided between the first contact portion 16*a* and the second contact portion 16*b*. This stop 36 passes with a certain clearance within a central opening of the assembly, which allows the geometric defects of the components to be compensated for. Finally, a third contact portion 16*c* disposed on the hammer 6 near the first end 10*a* of the flexible element 10, contacts the heart-piece 14 of the minute wheel set 4. This third contact portion 16*c* is connected by a U-shaped metal strip, and its end opposite the contact portion is fastened by stud-bolts 43 or other fastening means to the upper end of the hammer 6. An adjustment eccentric 44 is fastened in a hole corresponding to the upper end of the hammer 6 to adjust the position of the third contact portion 16*c*.

Figure 3A:
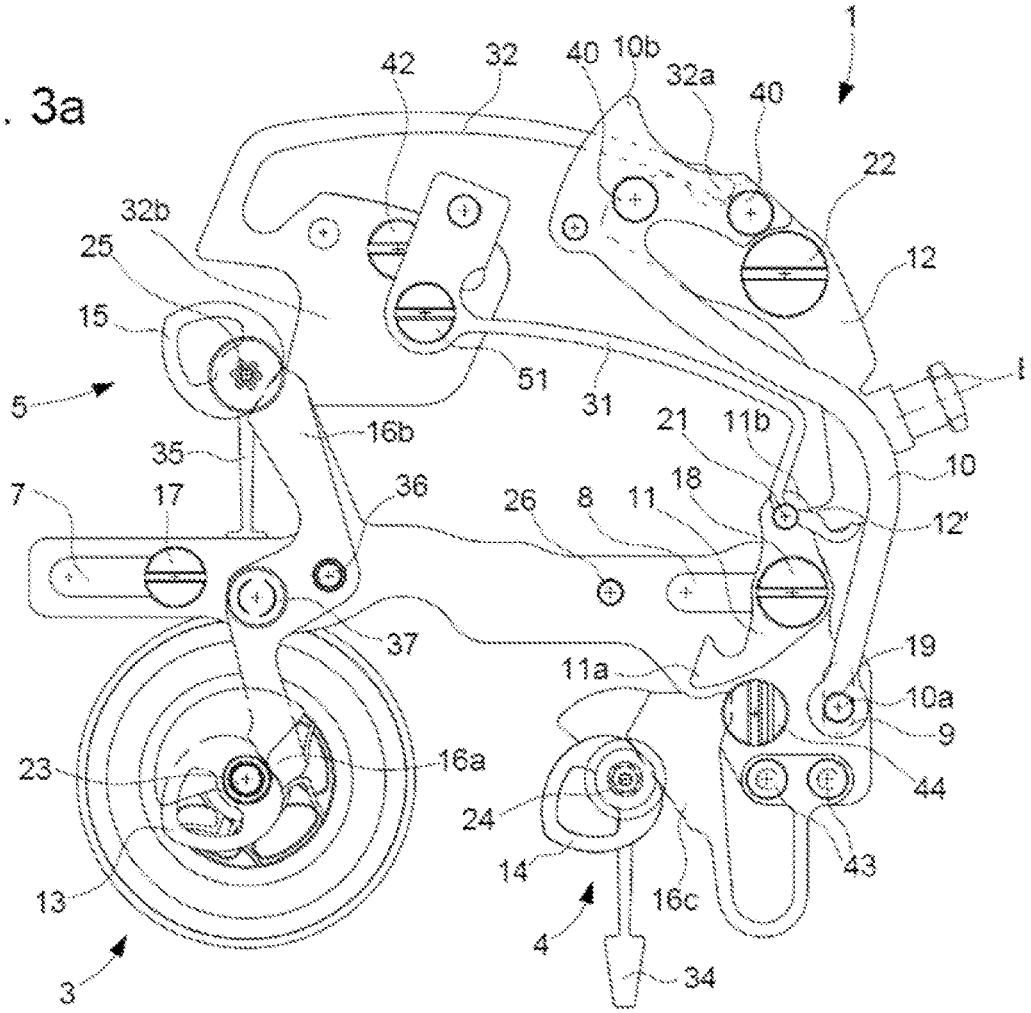
FIGS. 3*a* and 3*b* show a bottom view and a three-dimensional bottom view of the chronograph reset system during the resetting operation of the chronograph once the hammer is unblocked according to the invention.
Figure 3B:
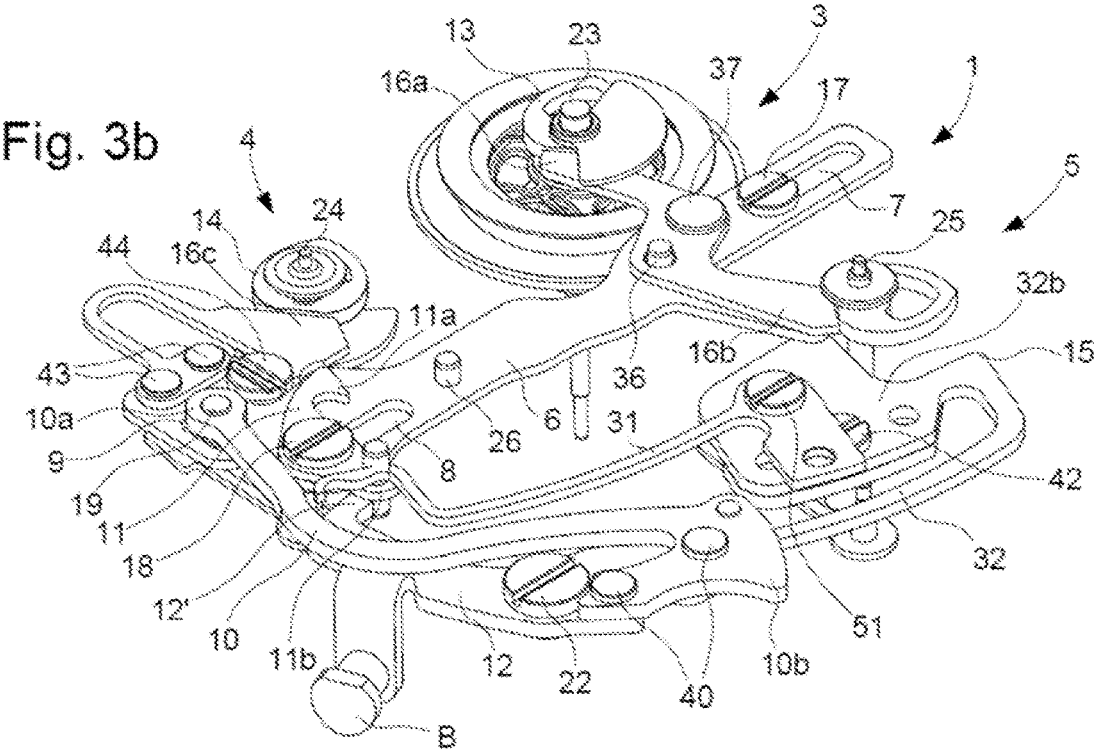

The position of these three wheel sets 3, 4, 5 and of the contact portions 16*a*, 16*b*, 16*c* at the end of the resetting of the chronograph, are shown explicitly in FIGS. 3*a* and 3*b*, which will not be described in more detail since they comprise the same elements described above in FIGS. 1*a* and 1*b*. Each flat of the heart-pieces 13, 14, 15 are held in a zero position by each respective contact portion 16*a*, 16*b*, 16*c*. The screws or other rods 17 and 18, which are in each longitudinal opening 7 and 8, are at a high end of the longitudinal openings 7 and 8 when resetting and before being placed in an inactive blocked position of the hammer 6 after the push-button B is released. The length of each longitudinal opening 7 and 8 is determined in such a way that each screw 17 and 18 can displace from an inactive position during the blocking of the hammer 6 and an active reset position.

For purely illustrative purposes, a minute hand 34 must be frictionally connected on the axis 24 to indicate the chronograph minutes on a dial of the timepiece which is not shown. An hour hand 35 must be frictionally connected on the axis 25 to indicate the chronograph hours on the dial of the timepiece which is not shown. The same can be done for the chronograph seconds indication, but no hand is shown.

In order to return the flexible element 10 to its initial position after the push-button B is released, it can be provided to have another return spring 32, a free end 32*a* of which contacts in a housing 41 made in the first portion of the rotary control lever 12 under the second end 10*b* of the flexible element 10. The other end 32*b* of the return spring 32 is fastened by means of a screw 42, which is screwed into a corresponding thread produced in the base or the frame or the plate of the timepiece. Once the flexible element 10 and the push-button B are in an initial position, the return spring 31 pushes the hook organ 11 into its blocking position of the hammer in a conventional manner before a next reset operation of the chronograph.

Figure 2:
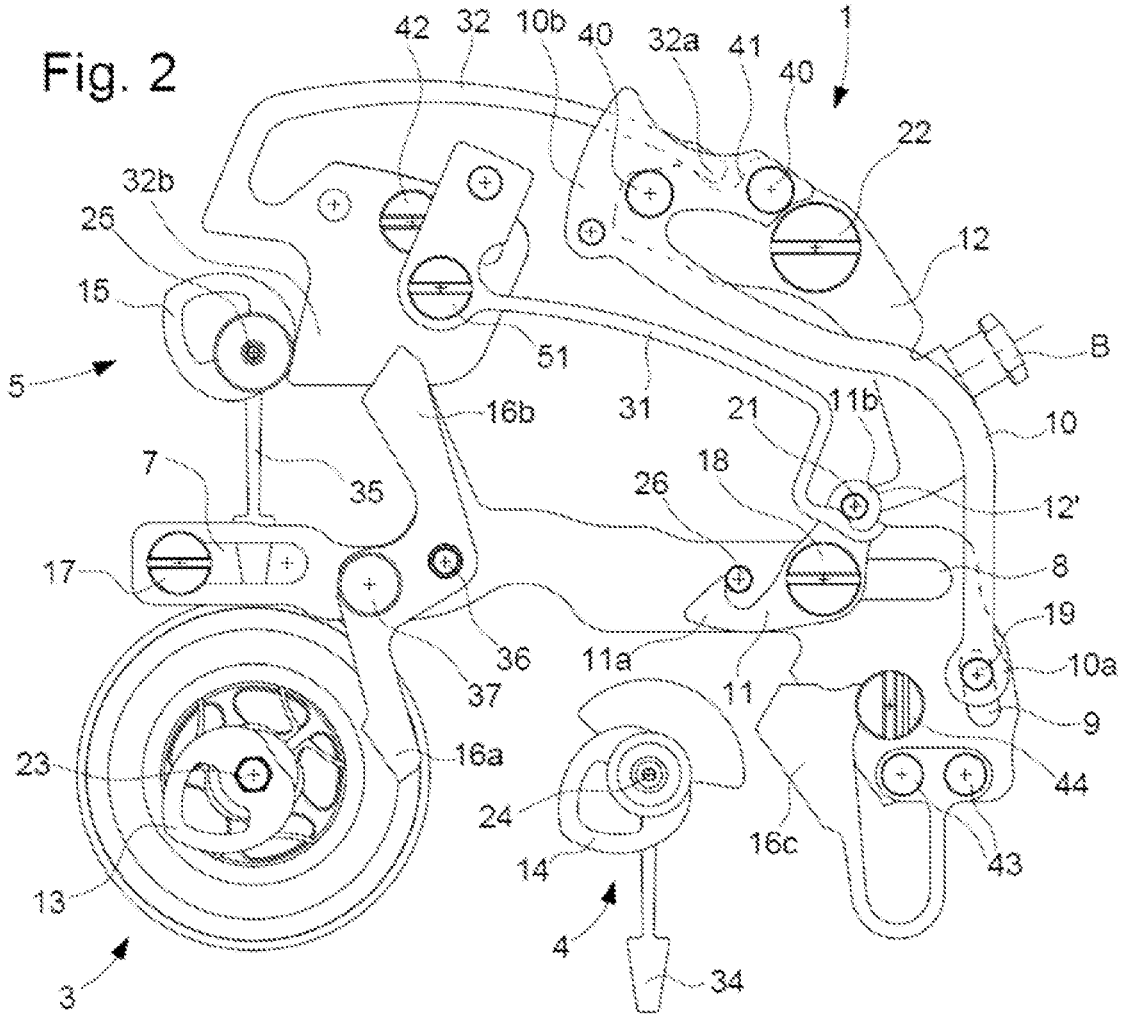
FIG. 2 shows a bottom view of the chronograph reset system just before the unblocking of a hammer for the resetting operation the chronograph according to the invention.

FIG. 2, which only shows the bottom view of the chronograph reset system, just allows the energy stored by the flexible element 10 to be illustratively seen just before unblocking the hammer 6 when the hook at the first end 11*a* of the hook organ 11 releases it from the blocking. By the rotation of the control lever 12, the second end 10*b* of the flexible element 10 tends to rotate in the clockwise direction, straightening the flexible element 10 and thus storing the energy to be restored when resetting the chronograph. Of course, all the other components of FIG. 2 will not be repeated as they have already been explained with reference to FIGS. 1*a* and 1*b*.

FIGS. 4 and 5 below show a chronograph counting geartrain 2, which comprises on the one hand a minute geartrain in FIG. 4 and on the other hand an hour geartrain in FIG. 5. The various wheels for the minute geartrain and the hour geartrain are shown connected by dotted lines. Mainly in the case of the minute geartrain, which is shown in FIG. 4, a first toothed wheel 62 disposed on the axis 23 of the chronograph wheel set 3 meshes with an intermediate wheel 63, the diameter of which is larger than the diameter of the first toothed wheel 62. A second intermediate wheel 64 of smaller diameter is placed on the intermediate wheel 63 to drive an hour geartrain explained below. A third coaxial proximal intermediate wheel 65 and of smaller diameter than the intermediate wheel 63 allows a large wheel 66 mounted on the axis 24 of the minute wheel set 4 to be driven. The dimension of each wheel is of course determined according to the time counted and to be displayed to switch from the second with a first indicator organ to the minute with a second indicator organ, such as a hand 34 on a dial which is not shown.

FIG. 5 mainly represents the hour wheel. The first toothed wheel 62 disposed on the axis 23 of the chronograph wheel set 3 meshes with the intermediate wheel 63, the diameter of which is larger than the diameter of the first toothed wheel 62. The second intermediate wheel 64 of smaller diameter meshes with a second intermediate wheel 68 of larger diameter which in turn comprises below another small intermediate wheel which is intended to drive another large wheel 67, of which a proximal wheel of smaller diameter on the same axis drives an hour wheel 69. The dimension of each wheel is of course determined according to the time counted and to be displayed in order to switch from the second with a first indicator organ to the hour with a third indicator organ, such as a hand 35 on a dial which is not shown.

It can also be noticed in FIGS. 4 and 5, the minute 34 and hour 35 indication hands which are not directly connected to their respective axes of the wheel sets 4 and 5. The heart-pieces 14 and 15 of the minute and hour wheel sets 4 and 5 are each disposed under the wheels 66 and 69. Both the minute geartrain and the hour geartrain are well known in this technical field of a chronograph timepiece. No other details will be explained more precisely.

Figure 6:
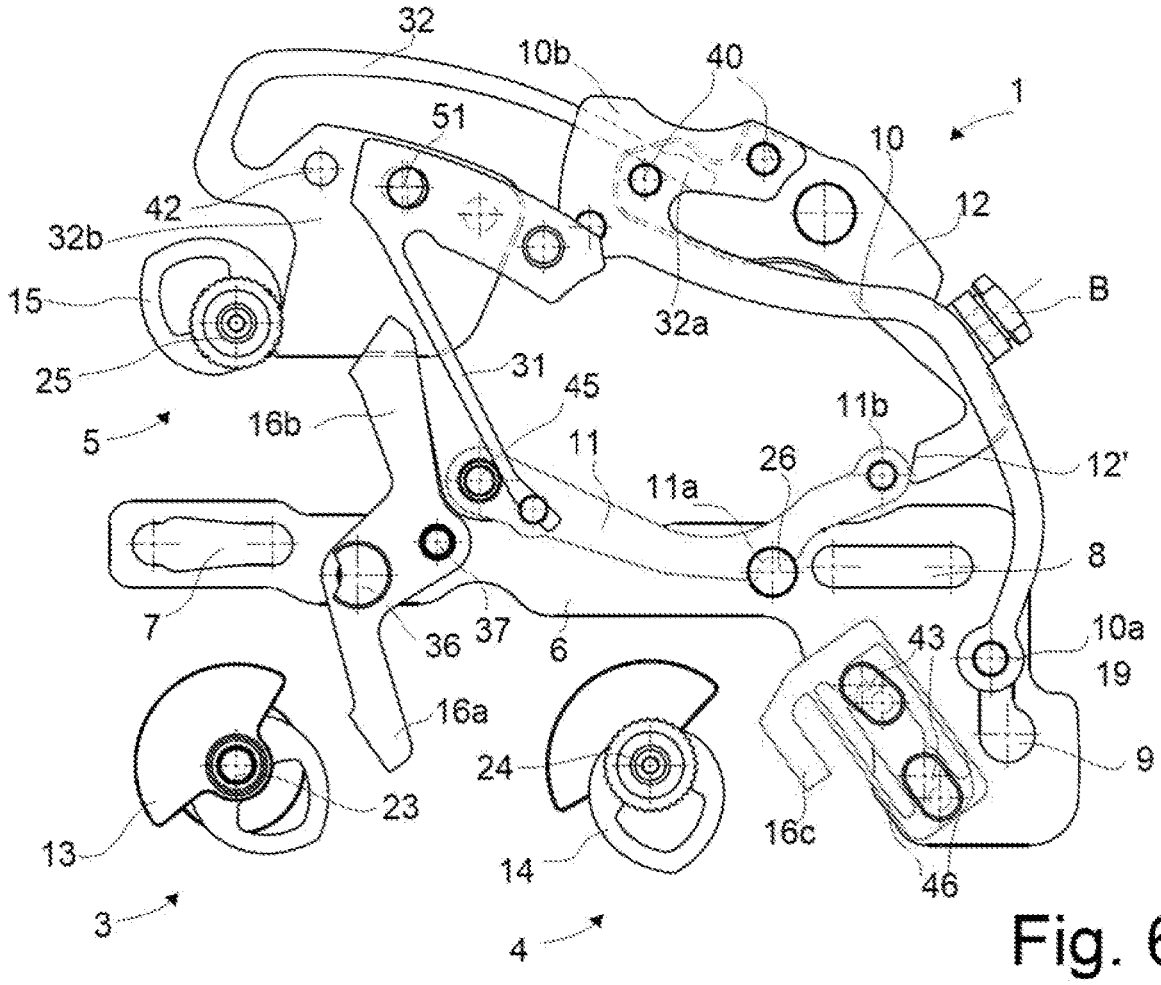
FIG. 6 shows a bottom view of another embodiment of the chronograph reset system before the resetting operation of the chronograph according to the invention.

FIG. 6 shows a bottom view of the main elements of another embodiment of a system 1 for resetting a chronograph in a position before the resetting operation. The same elements described in FIG. 1*a* will therefore not be repeated, but on the other hand, the new elements are described in relation to the hook organ 11 and a new third contact portion 16*c*.

The hook organ 11 is rotatably mounted about an axis 45 at a first end, and the second end 11*b* is in contact with an inner end 12' of the second portion of the control lever 12. A support 11*a* of an intermediate part of the hook organ 11 is disposed in contact with the pin 26 of the hammer 6.

The new third contact portion 16*c* is a so-called flexible pane, which comprises flexible blades 46 used to adjust the force in contact with the heart-piece 14. These flexible blades 46 are disposed on either side of the central part of the so-called flexible pane, and substantially parallel to each other. This so-called flexible pane is fastened on one end of the hammer 6 by means of screws or stud-bolts 43 in the oblong-shaped openings to adjust the positioning before fastening. With this configuration of this so-called flexible pane, this allows the geometric defects of the components to be compensated for and ensures a correct reset by an identical contact on the three heart-pieces of the wheel sets (hyperstatic system). It is no longer necessary in this configuration to use a mechanical adjustment as shown in particular in FIG. 1*a* and subsequent figures.

From the description which has just been given, multiple variant embodiments of the reset system for resetting a chronograph can be designed by the person skilled in the art without departing from the scope of the invention defined by the claims. Provision can be made of one or more flexible elements of identical or different shape, and disposed between one end of the hammer and the control lever. In addition, it can be considered to have one or more hammers which are rotary and not with linear movement for resetting the chronograph.

The invention claimed is:

1. A system for resetting a chronograph timepiece, which is provided with a chronograph counting geartrain, which comprises at least a minute counter having a minute wheel set (4), and a seconds counter, which comprises a chronograph wheel set, the minute wheel set including a heart-piece, constituting a cam shape, mounted on a central axis of the minute wheel set and the chronograph wheel set including a heart-piece mounted on a central axis of the chronograph wheel set, the system comprising a hammer held blocked by a blocking means and able to be displaced from an inactive position, where the hammer is blocked by the blocking means, and an active position, when the hammer is unblocked, for resetting the chronograph in contact with the various heart-pieces of the wheel sets, the system comprising a flexible element connected between a reset control means and the hammer used for resetting the chronograph, the flexible element being configured so as to store energy during a displacement of the control means before unblocking the hammer by the blocking means to be able, when the hammer is unblocked, to restore this stored energy and drive the hammer to reset the chronograph, wherein the hammer is mounted in translation with a first longitudinal opening and a second longitudinal opening wherein are placed fixed rods, including a first screw in the first longitudinal opening of the hammer and a second screw in the second longitudinal opening of the hammer, the hammer displacing rectilinearly from the inactive position to the active reset position, the two screws being screwed into threads provided for this purpose on a base or a frame or a plate of the timepiece.

2. The system according to claim 1, wherein the flexible element is linked by a first end to the hammer, which is used for resetting the chronograph, and wherein a second end of the flexible element is fastened to the control means which is mounted on a base or a frame or a plate of the timepiece.

3. The system according to claim 2, wherein the first end of the flexible element is connected by means of a rod or a pin inserted into an elongated opening formed at a flat end of the hammer.

4. The system according to claim 2, wherein the flexible element is arcuate in shape between its first end and its second end, this arcuate shape being in the direction of an external activation organ (B) of the control means.

5. The system according to claim 1, wherein the control means is a control lever, which is rotatably mounted by a fastening element passing through a central opening of the control lever and which is fastened in the base or the frame or the plate of the timepiece.

6. The system according to claim 5, wherein the control lever is rotatably mounted by a mounting screw passing through the central opening of the control lever and which is fixedly screwed into a corresponding thread in the base or the frame or the plate of the timepiece.

7. The system according to claim 6, wherein the control lever comprises a first portion on a first side of an axis on which the second end of the flexible element is fastened by fastening means, and wherein the control lever comprises a second portion on a second side of the axis opposite to the first side, and at one end of which can act the external activation organ, which is a push-button (B).

8. The system according to claim 1, wherein the blocking means comprises a hook organ rotatably mounted on the hammer, the second screw for guiding the hammer passing through a central opening of the hook organ and on the upper side of the hammer in the direction of the control means, wherein the hook organ comprises a first end with a hook for hooking onto a pin fastened vertically on the hammer (6) near the second longitudinal opening and between the two longitudinal openings, and wherein the hook organ comprises a second end on a side opposite to the first end relative to an axis of rotation, a rod being mounted through the second end and being disposed to be pushed by part of the control means in a reset operation.

9. The system according to claim 8, wherein the control means is a control lever rotatably mounted by a mounting screw passing through the central opening of the control lever and which is fixedly screwed into a corresponding thread in the base or the frame or the plate of the timepiece, wherein the control lever comprises a first portion on a first side of the fastening axis of the second end of the flexible element, wherein the control lever comprises a second portion on a second side of the axis opposite to the first side, and at one end of which can act a push-button (B), and wherein an inner end of the second portion of the control lever is disposed facing and remote from the second end of the hook organ so as to allow the flexible element to store energy when the push-button is pressed before the rod of the second end of the hook organ is pushed by the inner end of the second portion of the lever and until the hook of the first end is no longer hooked to the pin of the hammer to restore the energy stored to drive the hammer in the resetting of the chronograph.

10. The system according to claim 9, the chronograph further comprising an hour counter provided with an hour wheel set, a heart-piece of the hour wheel set being mounted on a central axis of the hour wheel set, wherein the unblocked hammer is pushed by the flexible element from its first end and in the direction of the various heart-pieces of the wheel sets, wherein the hammer comprises three contact portions, a first contact portion disposed on the hammer being in contact with the heart-piece of the chronograph wheel set, a second contact portion disposed on the hammer being in contact with the heart-piece of the hour wheel set, and a third contact portion disposed on the hammer near the first end of the flexible element being in contact with the heart-piece of the minute wheel set.

11. The system according to claim 10, wherein the first contact portion and the second contact portion form an assembly rotatably mounted about an axis on the hammer near the first longitudinal opening, and wherein an angular stop is disposed between the first contact portion and the second contact portion passing through a central opening of the assembly with a certain clearance.

12. The system according to claim 10, wherein the third contact portion is connected by a U-shaped metal strip and its end opposite the contact portion is fastened by stud-bolts to the upper end of the hammer.

13. The system according to claim 12, wherein an adjustment eccentric is fastened in a hole corresponding to the upper end of the hammer to adjust the position of the third contact portion.

14. The system according to claim 10, wherein the third contact portion is a flexible pane, which comprises flexible blades used to adjust the force in contact with the heart-piece.

15. The system according to claim 14, wherein these flexible blades are disposed on either side of the central part of the flexible pane, and substantially parallel to each other, and wherein the flexible pane is fastened on one end of the hammer by means of screws or stud-bolts in the oblong-shaped openings to adjust the positioning before fastening.

* * * * *